US007070307B2

(12) United States Patent
Koegler

(10) Patent No.: US 7,070,307 B2
(45) Date of Patent: Jul. 4, 2006

(54) REPLACEABLE LAMP ASSEMBLY HAVING A CAP

(75) Inventor: John M. Koegler, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 132 days.

(21) Appl. No.: 10/769,325

(22) Filed: Jan. 30, 2004

(65) Prior Publication Data

US 2005/0168988 A1 Aug. 4, 2005

(51) Int. Cl.
*F21V 15/00* (2006.01)

(52) U.S. Cl. ..... 362/378; 362/377; 362/307; 362/344

(58) Field of Classification Search ..... 362/185–186, 362/189–190, 351–352, 375–377, 368, 310, 362/450, 353, 549, 306–307, 344, 226
See application file for complete search history.

(56) References Cited

U.S. PATENT DOCUMENTS

| | | | | | |
|---|---|---|---|---|---|
| 765,568 | A | * | 7/1904 | Eisenmann | 362/377 |
| 781,391 | A | * | 1/1905 | Blake | 362/377 |
| 973,050 | A | * | 10/1910 | Keller | 362/293 |
| 4,318,158 | A | * | 3/1982 | Livermore et al. | 362/29 |
| 5,010,455 | A | * | 4/1991 | Luallin et al. | 362/519 |
| 5,347,324 | A | | 9/1994 | Sasaki et al. | |
| 6,062,703 | A | * | 5/2000 | Tsao | 362/184 |
| 6,422,721 | B1 | | 7/2002 | Plunk et al. | |
| 6,502,962 | B1 | | 1/2003 | Menke et al. | |

* cited by examiner

*Primary Examiner*—John Anthony Ward
*Assistant Examiner*—Robert May

(57) ABSTRACT

A replaceable lamp assembly includes a lamp coupled to a lamp header; and a cap coupled to the lamp header that at least partially covers the lamp. The cap minimizes contamination of the lamp and is configured to allow selective exposure of the lamp.

19 Claims, 7 Drawing Sheets

REPLACEABLE LAMP ASSEMBLY HAVING A CAP

BACKGROUND

Digital projectors, such as digital mirror devices (DMD) and liquid crystal display (LCD) projectors, project high quality images onto a viewing surface. Both DMD and LCD projectors utilize high intensity lamps and reflectors to generate the light needed for projection. Light generated by the lamp is concentrated as a 'fireball' that is located at a focal point of a reflector. Light produced by the fireball is directed into a projection assembly that produces images and utilizes the generated light to form the image. The image is then projected onto a viewing surface. Misalignment of the focal point causes degradation of the image since less light is captured and creates 'hot spots' on the screen instead of a uniform brightness.

Efforts have been directed at making projectors more compact while making the image of higher and higher quality. As a result, the lamps utilized have become more compact and of higher intensity. Higher intensity lamps produce high, even extreme heat. The outer surface of the lamps can approach temperatures of 900° C. As a result, projector designs must account for the intense heat.

In addition, contaminants such as oils or other contaminants, reduce the useful life of a lamp assembly if they are allowed to be deposited on the lamp. Such contamination of the lamp can occur if a user handles or touches the bulb portion of the lamp. The natural oils from the user's hands may be deposited on the lamp. Additionally, if there is any dirt or other contaminants on the user's hands, the dirt or other contaminants may also get deposited on the lamp. When the lamp is repeatedly heated to an operating temperature, such contamination on the lamp may reduce the operating life of the lamp or, in some cases, may cause the lamp to break and potentially damage surrounding structures.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

DETAILED DESCRIPTION

A replaceable lamp assembly includes a lamp coupled to a lamp header, and a generally hollow cap coupled to the lamp header in which the cap is configured to minimize a contamination of the lamp assembly by facilitating a selective exposure of the lamp.

In the following description, for purposes of explanation, numerous specific details are set forth in order to provide a thorough understanding of the present method and apparatus. It will be apparent, however, to one skilled in the art that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
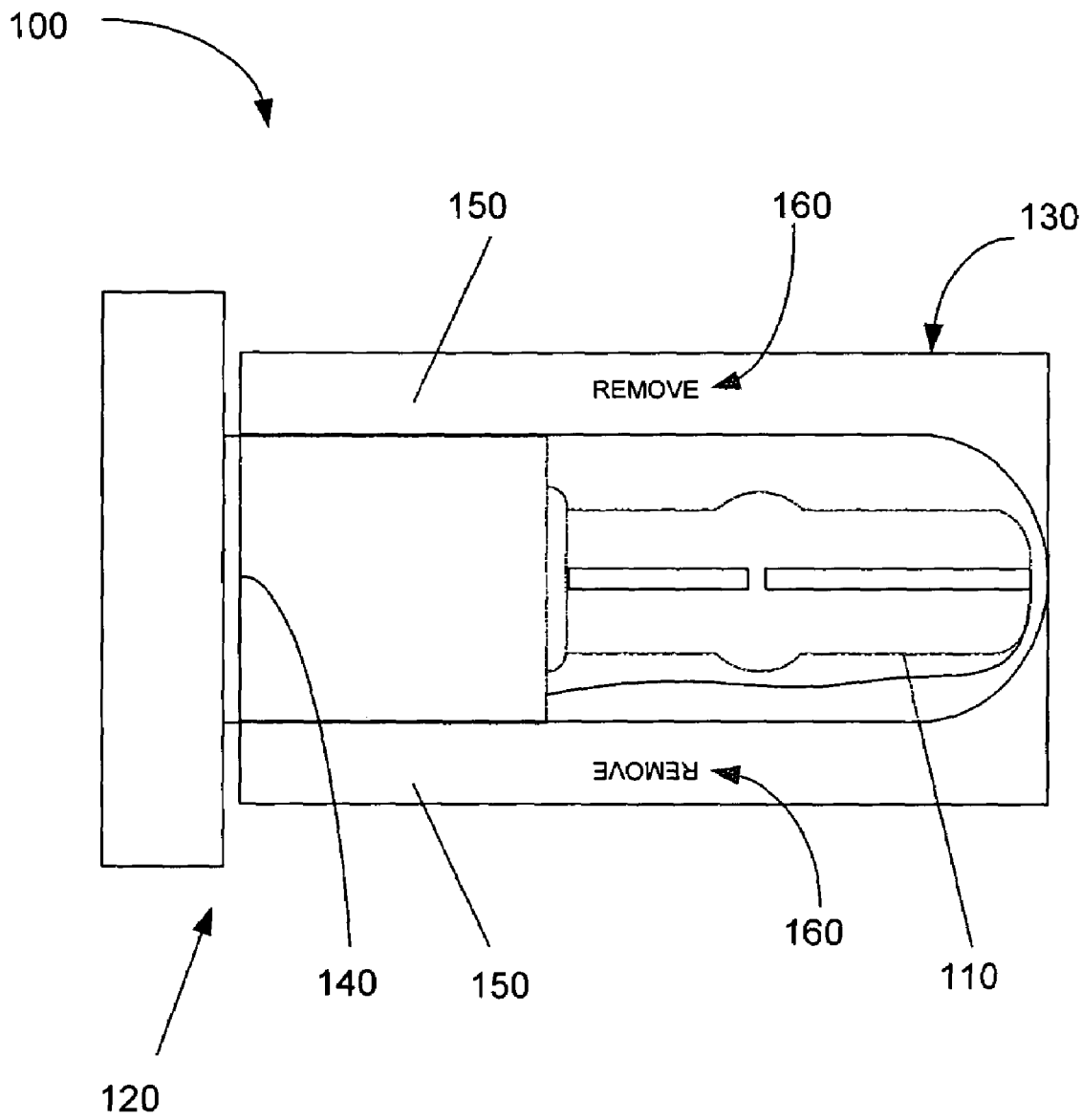
FIG. 1 illustrates a lamp assembly having a cap according to one exemplary embodiment.

FIG. 1 illustrates a lamp assembly (100) which generally includes a lamp (110) which is aligned with respect to a lamp header (120) and coupled thereto. As used herein, a "lamp header" is a member that receives a light bulb or lamp (110) and electrically connects that lamp (110) to the electrical system of a projection display or television system. A cap (130) covers the lamp (110). The cap (130) is generally hollow such that the lamp (110) may be placed therein by way of a lamp receiving portion. The cap (130) also includes a header engagement member (140) which couples the cap (130) to the lamp header (120). In this regard, "couple" is used to mean that an end of the cap (130) abuts and/or is attached to the lamp header (120). The cap (130) may be made, for example, from a plastic material.

The header engagement member (140) couples the cap (130) to the lamp header (120) such that the cap (130) remains coupled to the lamp header (120) until the cap (130) is removed by a user as will be discussed below. While the cap (130) is coupled to the lamp header (120), the cap (130) protects the lamp (110) from contamination. Possible sources of contamination include oil and/or dirt deposited by touching the lamp. Contamination of the lamp decreases its useful life, which increases the operating costs of a projector system. In the illustrated implementation, the cap (130) is has a closed end that enclosing the lamp (110) at an end opposite the lamp header (120). The cap (130) is coupled to the lamp assembly (100) by passing the lamp (110) into the cap (130) through the lamp receiving portion until the header engagement member (140) is coupled to the lamp header (120). As a result, in the illustrated implementation, the lamp (110) is enclosed and protected by the cap (130).

Figure 2:
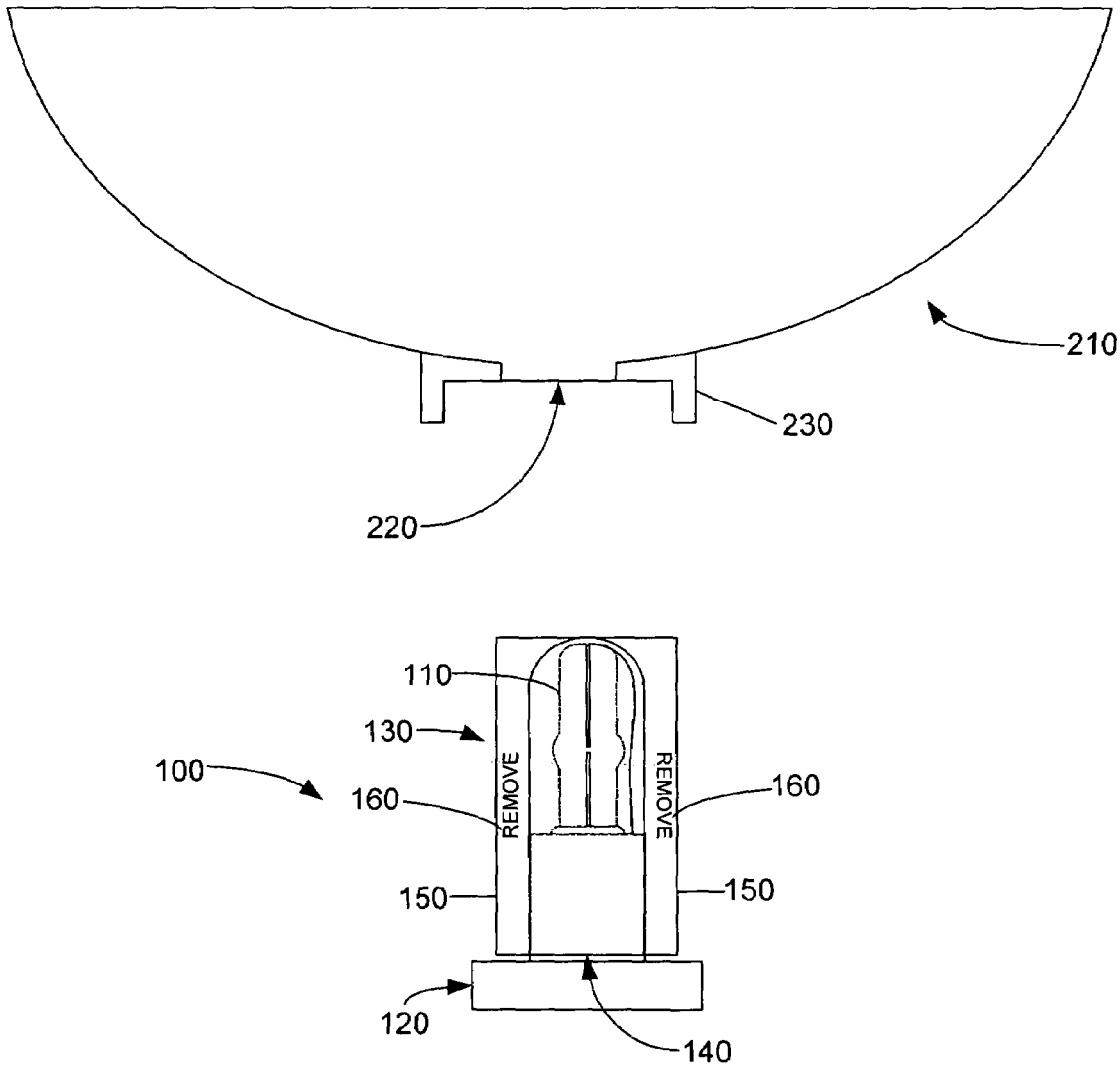
FIG. 2 illustrates a light generation assembly according to one exemplary embodiment.

The cap (130) further includes tabs (150). The tabs (150) may include a warning (160) inscribed thereon, which remind a user to remove the cap (130) before coupling the lamp assembly (100) to a reflector assembly (210; FIG. 2), as discussed below with reference to FIGS. 2–3.

Exemplary Implementation and Operation

FIG. 2 illustrates a light generation system (210), which includes a lamp assembly (100) with a cap (130) and a reflector assembly (210). The reflector assembly (210) has a reflector opening (220) defined therein into which the lamp assembly (100) is installed to place the lamp (110) within the reflector assembly (210). The reflector assembly (210) further includes a latching assembly (230) for releasably securing the lamp assembly (100) to the reflector assembly (210).

The tabs (150) of the cap (130) on the lamp assembly (100) prevent the unintended coupling of the lamp assembly (100) to the reflector assembly (210). This is achieved because the tabs (150) give the cap (130) a width greater than the reflector opening (220) which prevents the insertion of the lamp assembly (100) into the reflector assembly (210) while the cap (130) is coupled to the lamp assembly (100).

As a result, the cap (130), which may include a cover enclosed on one end, minimizes the possibility of a user contaminating or damaging the lamp (110) with oil, dirt and/or other contaminants. When needed for use, the lamp (110) may be selectively exposed by removing the cap (130), such that the lamp assembly (100) may be installed in the reflector assembly (210). The tabs (150) of the cap (130) not only prevent the lamp (110) from being unintentionally coupled to the reflector assembly (210), but also facilitate removal of the cap (130) by providing surfaces which may be grasped without grasping the lamp (110).

Figure 3:
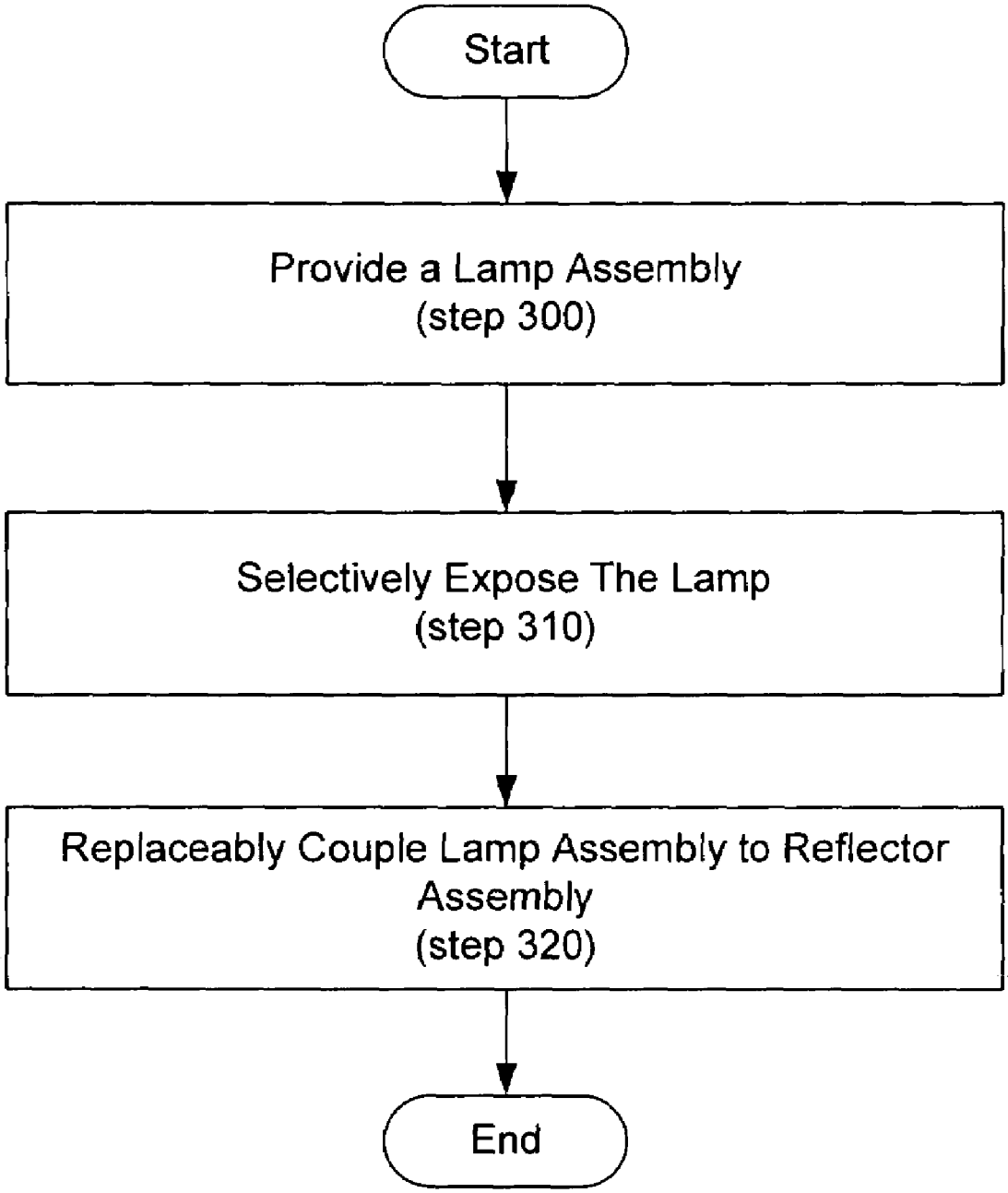
FIG. 3 is a flowchart illustrating a method of using a lamp assembly according to one exemplary embodiment.

FIG. 3 is a flowchart illustrating a method of using a lamp assembly. The method begins by providing a lamp assembly (step 300). The lamp assembly includes a lamp coupled to a lamp header and a generally hollow cap in which is defined a lamp receiving opening. Further, the cap includes a header engaging member coupled to the lamp header. The cap is configured to minimize contamination of the lamp assembly by enclosing and protecting the lamp prior to insertion in a reflector assembly. In particular, the cap is configured to prevent contamination of the lamp that can occur if a user handles the lamp.

As described above, in some embodiments, the user can selectively expose the lamp (step 310) by removing the cap when the lamp is to be placed in service in a reflector assembly. In other embodiments, the lamp may be selectively exposed (step 310) before, while, or after the lamp assembly is coupled to a reflector assembly (step 320). In the implementation described with reference to FIGS. 1–2, the cap is removed and the lamp is exposed before the lamp assembly is coupled to the reflector assembly. In the implementations described with reference to FIGS. 5 and 6, the cap is removed and the lamp is selectively exposed as the lamp assembly is coupled to the reflector assembly.

Figure 4:
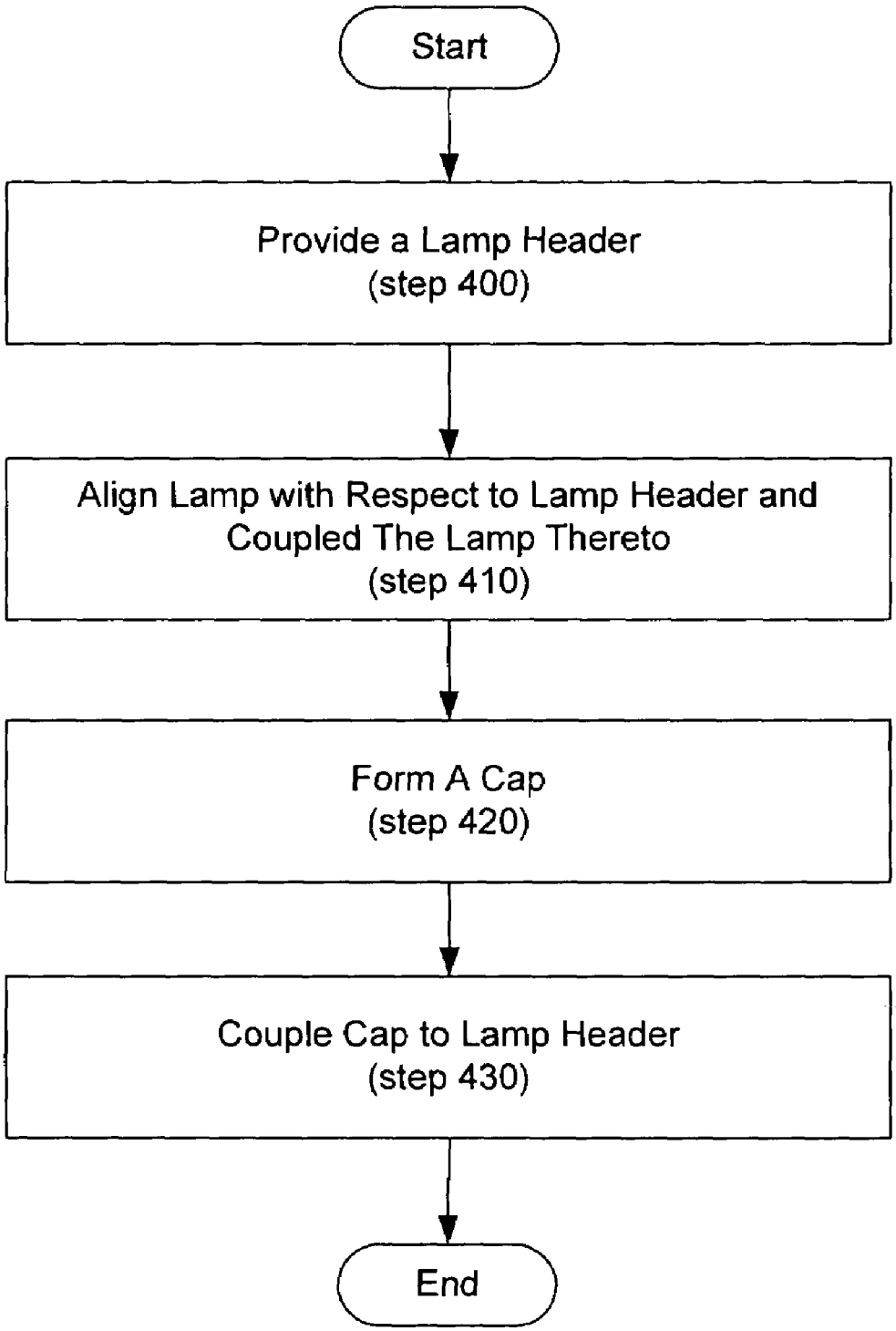
FIG. 4 is a flowchart illustrating a method of forming a lamp assembly according to one exemplary embodiment.

FIG. 4 is a flowchart illustrating a method of forming a lamp assembly having a protective cap as described herein. The method begins by providing a lamp header (step 400). The lamp header may be of any type configured to releasably couple the lamp assembly to a reflector assembly.

In the illustrated implementations, the lamp header includes a base and an annular lamp receiving portion. A lamp is then aligned with respect to the lamp header and coupled thereto (step 410). The lamp creates a fireball of light that is used by a projector system to create and project an image. During operation, the fireball creates extreme heat on the surface of the lamp. Any contamination on the lamp surface, such as oils, reduces the useful life of the lamp and may make operation of the lamp unsafe. Such contamination occurs most frequently from a user touching the lamp prior, during or even after installation in a projection system.

Consequently, a cap is then formed (step 420) which encloses and protects the lamp from contamination, while allowing the lamp to be released and used normally in a light generation assembly. For example, the formation of the cap may include the formation of a cover enclosed on one end as seen in FIGS. 1–2.

Figure 5:
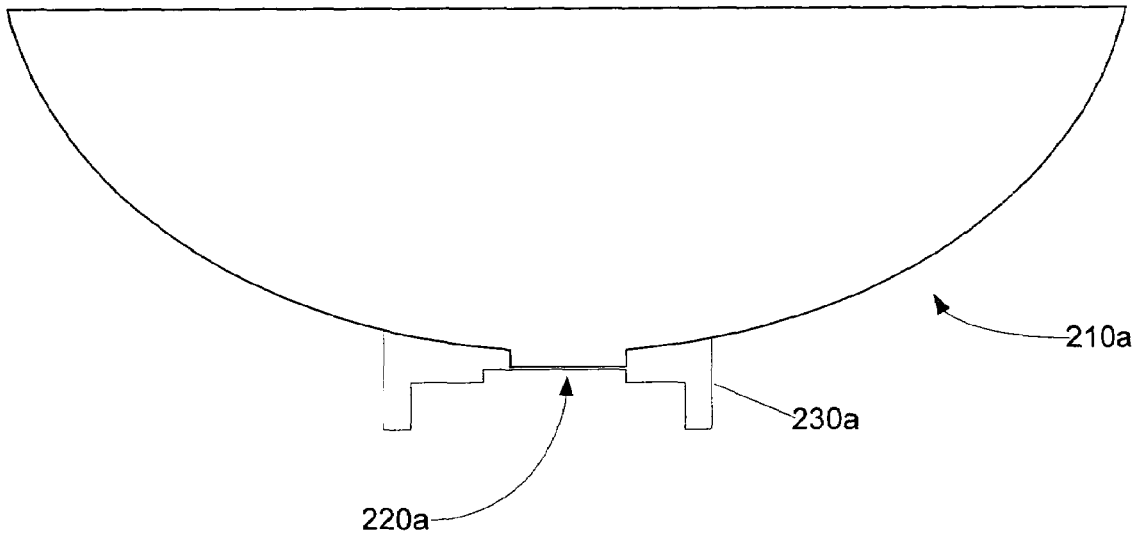
FIG. 5 illustrates a light generation assembly according to one exemplary embodiment.
Figure 5:
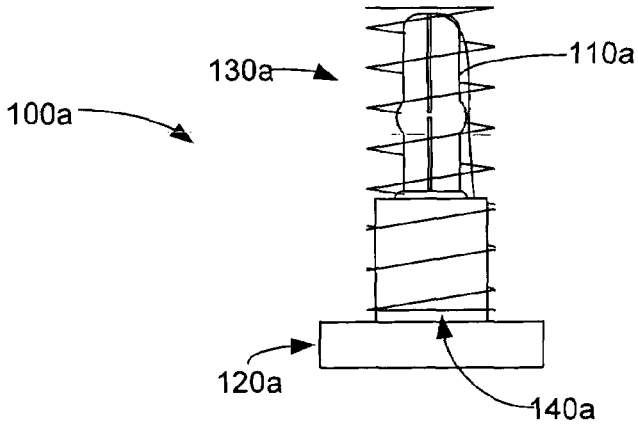
Figure 6:
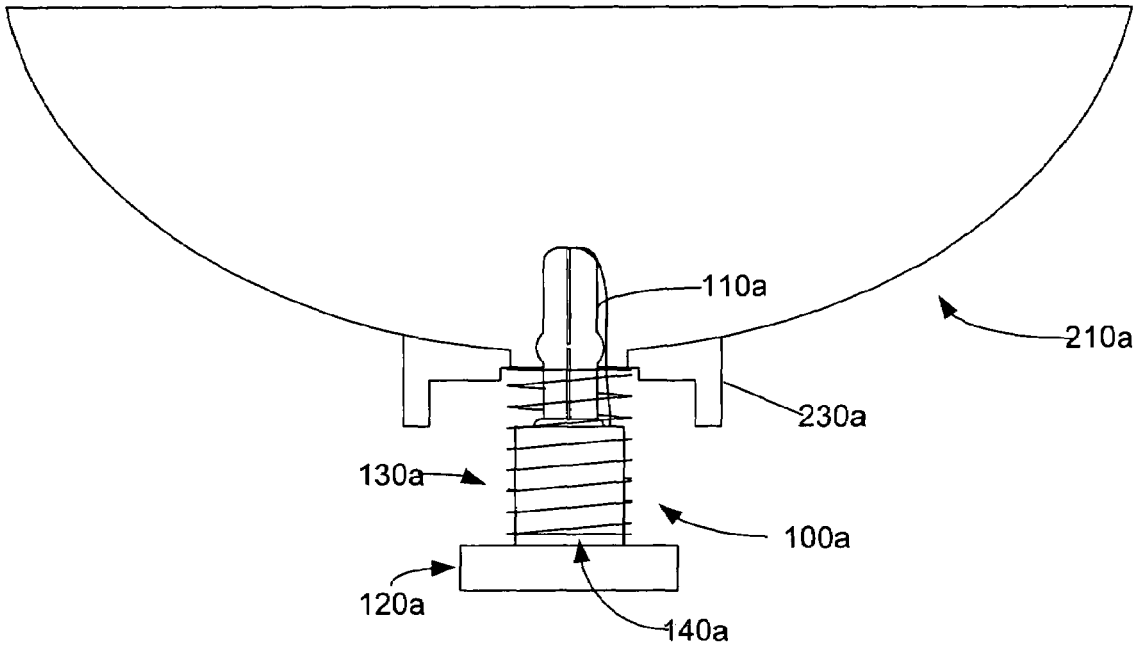
FIG. 6. illustrates another view of the embodiment of FIG. 5 as the lamp assembly is being installed in a reflector assembly.
Figure 7:
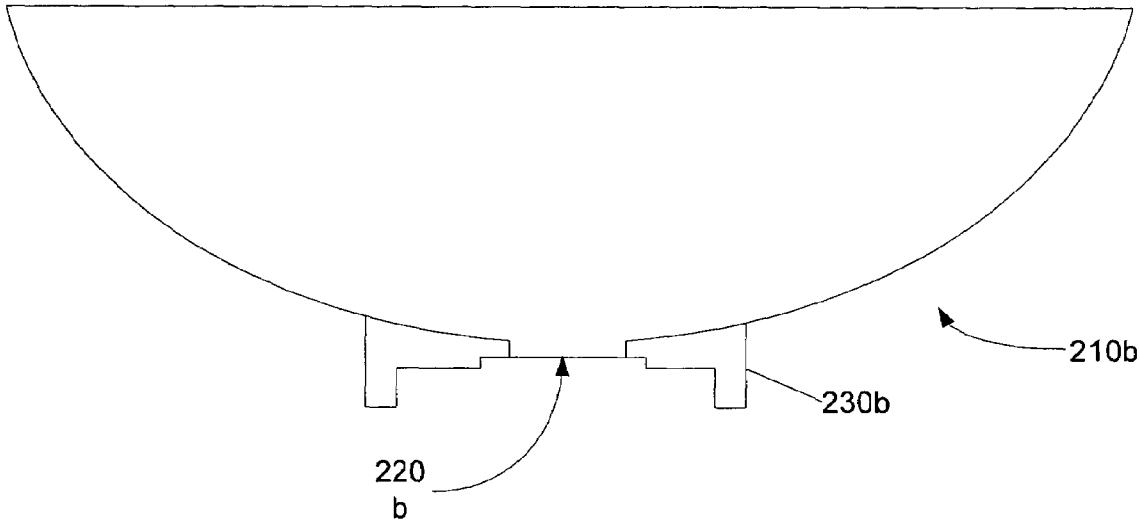
FIG. 7 illustrates a light generation assembly according to one exemplary embodiment Throughout the drawings, identical reference numbers designate similar, but not necessarily identical, elements.
Figure 7:
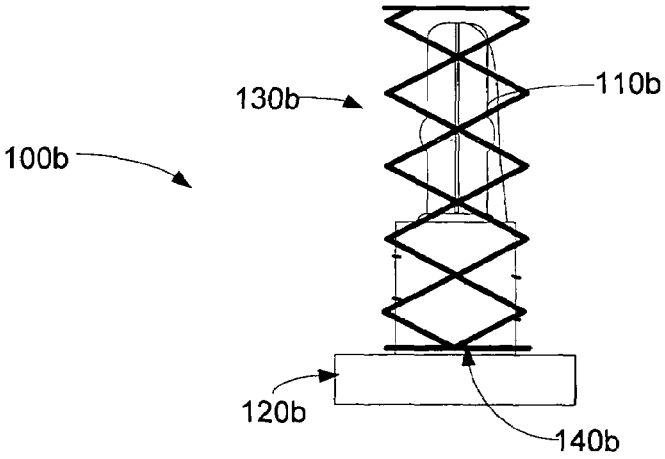

The cap (130; FIG. 1) facilitates selective exposure of the lamp by being selectively removable. Further, the formation of the cap may include formation of a collapsible or compressible member as shown in FIGS. 5–6. In FIG. 5, the lamp is selectively exposed by the resilient compression of the cap as the lamp assembly is coupled to a reflector assembly. In FIG. 7, the lamp is selectively exposed by the collapse of the cap as the lamp assembly is coupled to a reflector. The cap may be of any type that allows the selective exposure of the lamp. The selective exposure of the lamp prevents the contamination of the lamp, while otherwise allowing the lamp to be coupled to a reflector assembly.

The formation of the cap includes forming a lamp receiving opening and a header engaging portion. The cap is then coupled to the lamp header (step 430) by passing at least a portion of the lamp through the lamp receiving opening and coupling the header engagement portion to the lamp header.

Alternative Embodiments

In the implementation described with reference to FIGS. 1–2, the lamp (110) is selectively exposed by removing the cap (130) before the lamp assembly (100) is coupled to the reflector assembly (210). In the implementations described with reference to FIGS. 5–6, the caps (130*a*, FIG. 5; 130*b*, FIG. 7) are configured to facilitate selective exposure of the lamps (110*a*, 110*b*) as the lamp assemblies (100*a*, 100*b*) are coupled to reflector assemblies (210*a*, FIG. 5; 210*b*, FIG. 7). As a result, the caps (130*a*, 130*b*) also facilitate the selective exposure of a lamp (110*a*, 110*b*) while protecting the lamp prior to being placed in service. As indicated above, maintaining a protective guard around a lamp assembly prolongs the useful life of the lamp by minimizing the amount of contaminants deposited on the lamp by a user during installation or replacement of the lamp assembly.

FIG. 5 illustrates a lamp assembly (100*a*) in which the cap (130*a*) includes a header engagement member (140*a*) and a resilient member, such as a spring or a cover incorporating a spring. The cap (130*a*) facilitates the selective exposure of the lamp (110*a*) by compressing or collapsing as the lamp assembly (100*a*) is coupled to a reflector assembly (210*a*). The lamp assembly (100*a*) may be coupled to the reflector assembly (210*a*) with, for example, a latching assembly (230*a*).

As the lamp assembly (100*a*) is coupled to the reflector assembly (210*a*), a perimeter of the cap (130*a*) engages a perimeter of the reflector opening (220*a*). As the lamp (110*a*) is placed within the reflector assembly (210*a*), the perimeter of the reflector opening (220*a*) prevents the cap (130*a*) from entering the reflector assembly (210*a*). Accordingly, as the lamp (110*a*) is inserted through the reflector opening (220*a*), the cap (130*a*) compresses between the lamp header (120*a*) and the reflector assembly (210*a*). (See FIG. 6). Thus, the cap (130*a*) surrounds the lamp (110*a*) before and as the lamp assembly (100*a*) is coupled to the reflector assembly (210*a*). The compressed cap (130*a*) then allows the exposed lamp (110*a*) to extend into the reflector assembly (210*a*) and function normally.

FIG. 7 illustrates a lamp assembly (100*b*) having a cap (130*b*) which also includes a header engagement member (140*b*). The header engagement member (140*b*) is coupled to the lamp header (120*b*). The cap (130*b*) is collapsible similar to the cap of FIGS. 5 and 6. The cap (130*b*) facilitates the selective exposure of the lamp (110*b*) by yielding or collapsing as the lamp assembly (100*b*) is coupled to a reflector assembly (210*b*). The lamp assembly (100*b*) may be coupled to the reflector assembly (210*b*) with, for example, a latching assembly (230*b*).

As the lamp assembly (100*b*) is coupled to the reflector assembly (210*b*), a perimeter of the cap (130*b*) engages a perimeter of the reflector opening (220*b*). As the lamp (110*b*) is placed within the reflector assembly (210*b*), the perimeter of the reflector opening (220*b*) prevents the cap (130*b*) from entering the reflector assembly (210*b*). Accordingly, the cap collapses as the lamp (110*b*) is inserted into the reflector assembly (210*b*). The cap (130*b*) may be made of a material that collapses permanently under the pressure of the lamp (110*b*) being inserted into the reflector assembly (210*b*). Alternatively, similar to the embodiment of FIGS. 5 and 6, the cap (130*b*) may be resilient such that is collapses against a bias when the lamp (110*b*) is inserted into the reflector assembly (210*b*) and re-extends to cover the lamp (110*b*) when the lamp (110*b*) is removed from the reflector assembly (210*b*). In either case, the cap (130*b*) surrounds the lamp (110*b*) before the lamp assembly (100*b*) is coupled to the reflector assembly (210*b*) to prevent contamination of the lamp (110*b*).

In conclusion, the cap minimizes contamination of a lamp by facilitating the selective exposure of the lamp. The cap be removed or may remain with a lamp assembly as it is coupled to a reflector assembly. Further, the cap may be collapsed or resiliently compressed with respect to the reflector assembly. The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. A replaceable lamp assembly for a reflector, comprising:

a lamp coupled to a lamp header; and a cap coupled to said lamp header that at least partially covers said lamp to minimize a contamination of said lamp, wherein said cap is configured to be retracted to allow selective exposure of said lamp during when the replaceable lamp assembly is inserted into the reflector.

2. The assembly of claim 1, wherein said cap is configured to remain coupled to said lamp header.

3. The assembly of claim 1, wherein said cap comprises a collapsible member.

4. The assembly of claim 1, wherein said cap comprises a resilient member.

5. The assembly of claim 4, wherein said resilient member comprises a spring.

6. A light generation assembly, comprising:

a reflector assembly configured to have a lamp assembly removably coupled thereto;

said lamp assembly including a lamp coupled to a lamp header; and a cap that is coupled to said lamp header and is protecting said lamp, wherein said cap is configured to minimize contamination of said lamp by providing selective exposure of said lamp, wherein said cap is configured to remain coupled to said lamp header after coupling of the lamp assembly to the reflector assembly, and wherein said cap comprises a collapsible member which collapses during coupling of said lamp assembly to said reflector assembly thereby providing said selective exposure of said lamp.

7. A light generation assembly, comprising:

a reflector assembly configured to have a lamp assembly removably coupled thereto;

said lamp assembly including a lamp coupled to a lamp header; and a cap that is coupled to said lamp header and is protecting said lamp, wherein said cap is configured to minimize contamination of said lamp by providing selective exposure of said lamp, wherein said cap is configured to remain coupled to said lamp header after coupling of the lamp assembly to the reflector assembly, and wherein said cap comprises a resilient member which is resiliently collapsed during coupling of said lamp assembly to said reflector assembly, thereby providing said selective exposure of said lamp.

8. The assembly of claim 7, wherein said resilient member comprises a spring.

9. A method of forming a replaceable lamp assembly, comprising:

providing a lamp header;

providing a lamp coupled to said lamp header;

providing a cap that at least partially covers and protects said lamp, said cap comprising a header engaging member coupled to said lamp header; and configuring said cap to selectively expose said lamp by when said lamp is placed in service wherein said cap is configured to be collapsed when said lamp assembly is coupled to a reflector assembly, thereby providing said selective exposure of said lamp.

10. The method of claim 9, wherein said cap comprises a permanently collapsible member.

11. The method of claim 9, further comprising forming said cap to be resiliently compressed when said lamp assembly is coupled to a reflector assembly, thereby providing said selective exposure of said lamp.

12. The method of claim 11, wherein said cap comprises a spring member.

13. A method of using a lamp assembly, comprising:

preventing a contamination of a lamp by coupling a cap to a lamp header to at least partially cover and protect said lamp and facilitate a selective exposure of said lamp; and compressing said cap to selectively expose said lamp during coupling of said lamp assembly to a reflector assembly.

14. The method of claim 13, further comprising permanently collapsing said cap during said coupling of said lamp assembly to the reflector assembly.

15. The method of claim 13, wherein said cap comprises a resilient member.

16. The method of claim 15, further comprising resiliently compressing said cap during said coupling of said lamp assembly to the reflector assembly.

17. A replaceable lamp assembly for a reflector, comprising:

a lamp coupled to a lamp header; and protective means for protecting said lamp, said protective means being coupled to said lamp header and at least partially cover said lamp to minimize contamination of said lamp, wherein said protective means are configured to allow selective exposure of said lamp wherein said protective means comprise a collapsible member that collapses when said lamp is inserted into the reflector.

18. The assembly of claim 17, wherein said protective means comprise a resilient member.

19. The assembly of claim 18, wherein said resilient member comprises a spring.

* * * * *